US009879924B2

(12) United States Patent
Quinn et al.

(10) Patent No.: US 9,879,924 B2
(45) Date of Patent: Jan. 30, 2018

(54) HEAT SWITCH RADIATORS FOR VARIABLE RATE HEAT REJECTION

(71) Applicant: Hamilton Sundstrand Space Systems International, Inc., Windsor Locks, CT (US)

(72) Inventors: Gregory Quinn, Windsor Locks, CT (US); Mark A. Zaffetti, Suffield, CT (US); James R. O'Coin, Somers, CT (US)

(73) Assignee: Hamilton Sundstrand Space Systems International, Inc., Windsor Locks, CT (US)

( * ) Notice: Subject to any disclaimer, the term of this patent is extended or adjusted under 35 U.S.C. 154(b) by 815 days.

(21) Appl. No.: 14/163,339

(22) Filed: Jan. 24, 2014

(65) Prior Publication Data

US 2015/0211814 A1 Jul. 30, 2015

(51) Int. Cl.

| | |
|---|---|
| ***G05D 23/00*** | (2006.01) |
| ***F28F 13/06*** | (2006.01) |
| ***F28D 21/00*** | (2006.01) |
| *F28F 13/00* | (2006.01) |

(52) U.S. Cl.

CPC ..... *F28F 13/06* (2013.01); *F28D 21/00* (2013.01); *F28F 13/00* (2013.01); *F28D 2021/0021* (2013.01); *F28F 2013/005* (2013.01); *F28F 2013/008* (2013.01)

(58) Field of Classification Search

CPC ..... F28F 13/06; F28F 13/00; F28F 2013/008; F28F 2013/005; F28D 21/00; F28D 2021/0021

See application file for complete search history.

(56) References Cited

U.S. PATENT DOCUMENTS

| | | | | | |
|---|---|---|---|---|---|
| 3,844,341 | A | | 10/1974 | Bimshas, Jr. et al. | |
| 3,957,107 | A | * | 5/1976 | Altoz | F28D 15/06 165/104.26 |
| 4,273,183 | A | | 6/1981 | Altoz et al. | |
| 4,304,294 | A | * | 12/1981 | Reisman | F42B 15/34 165/185 |
| 4,454,910 | A | | 6/1984 | Miyazaki | |
| 4,676,300 | A | | 6/1987 | Miyazaki | |

(Continued)

FOREIGN PATENT DOCUMENTS

| | | | | | |
|---|---|---|---|---|---|
| DE | 202007003441 | U1 | | 4/2008 | |
| GB | 2503494 | A | | 1/2014 | |
| KR | 20090036371 | A | * | 4/2009 | F28F 13/00 |

OTHER PUBLICATIONS

Search Report and Opinion issued by the European Patent Office dated Jun. 2, 2015 for European Patent Application No. 15152532.

(Continued)

*Primary Examiner* — Ljiljana Ciric

(74) *Attorney, Agent, or Firm* — Locke Lord LLP; Scott D. Wofsy; Christopher J. Cillié

(57) ABSTRACT

A heat switch includes a heat sink, a coolant tube, and an actuator. The coolant tube is movable with respect to the heat sink. The actuator couples between the heat sink and the coolant tube and configured to move the coolant tube between a first position and a second position. Heat flow from the coolant tube into the heat sink is greater in the second position than in the first position for enhanced heat transfer from the coolant tube.

14 Claims, 6 Drawing Sheets

(56) References Cited

U.S. PATENT DOCUMENTS

| | | | | |
|---|---|---|---|---|
| 4,909,313 | A * | 3/1990 | Voss | F28F 13/00 165/46 |
| 5,083,373 | A | 1/1992 | Hamburgen | |
| 5,535,815 | A * | 7/1996 | Hyman | F28F 13/00 165/185 |
| 5,694,515 | A * | 12/1997 | Goswami | F24H 7/0433 137/341 |
| 6,138,748 | A | 10/2000 | Hamburgen et al. | |
| 6,276,144 | B1 | 8/2001 | Marland et al. | |
| 6,404,636 | B1 | 6/2002 | Staggers et al. | |
| 7,752,866 | B2 | 7/2010 | Vaidyanathan et al. | |
| 9,704,773 | B2 * | 7/2017 | Koehler | H01L 23/36 |
| 2003/0066638 | A1 * | 4/2003 | Qu | C09K 5/14 165/186 |
| 2005/0099776 | A1 | 5/2005 | Xue et al. | |
| 2005/0230097 | A1 * | 10/2005 | Shirron | F25B 21/00 165/275 |
| 2006/0066434 | A1 * | 3/2006 | Richards | B82Y 30/00 337/14 |
| 2007/0257766 | A1 * | 11/2007 | Richards | B82Y 10/00 337/298 |
| 2009/0032223 | A1 | 2/2009 | Zimmerman et al. | |
| 2009/0277609 | A1 * | 11/2009 | Chang | B82Y 10/00 165/96 |
| 2009/0288801 | A1 * | 11/2009 | Figus | B64G 1/506 165/47 |
| 2009/0293504 | A1 * | 12/2009 | Oomen | F25D 19/006 62/51.1 |
| 2010/0065263 | A1 * | 3/2010 | Tanchon | B64G 1/58 165/277 |
| 2015/0090436 | A1 * | 4/2015 | Andres | F28F 13/14 165/276 |

OTHER PUBLICATIONS

Mehoke, D.S., et al., "Development of the Miniature Spacecraft Energy Retention (MiSER) Thermal Control Panel", SAE 2001-01-2219, Presented at the 31st International Conference on Environmental Systems (ICES), Orlando, Fl., Jun. 2001.

* cited by examiner

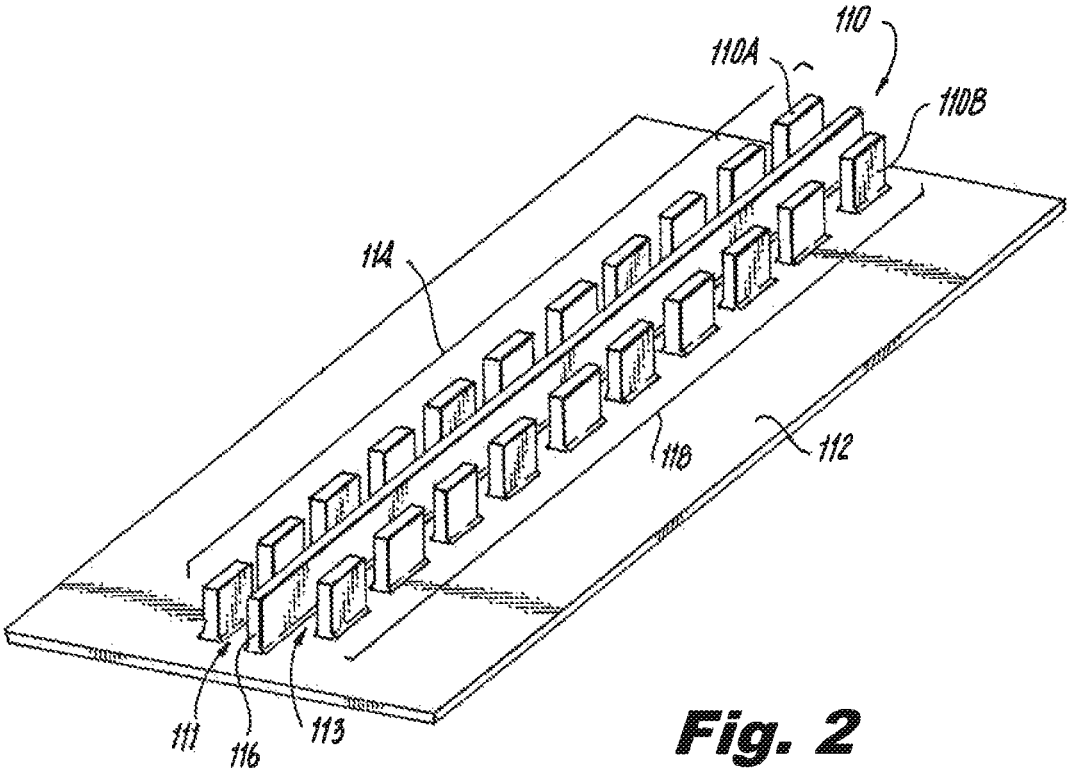
Fig. 2
Fig. 3
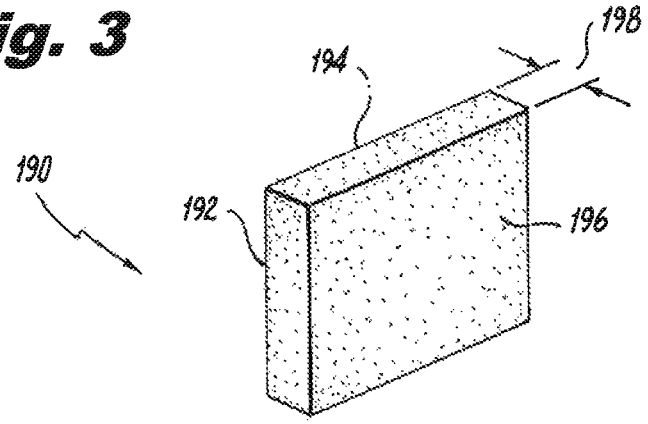

Fig. 6
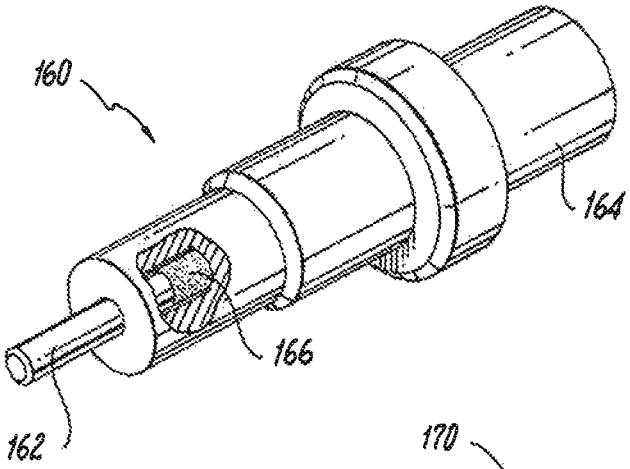
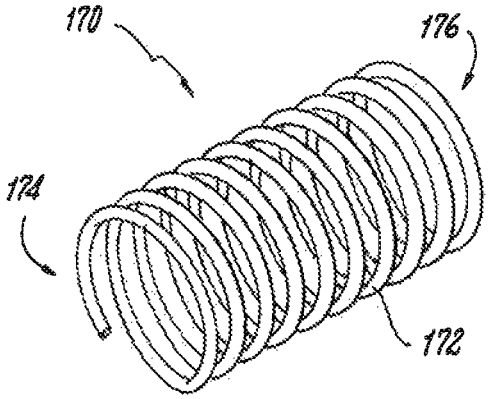
Fig. 7
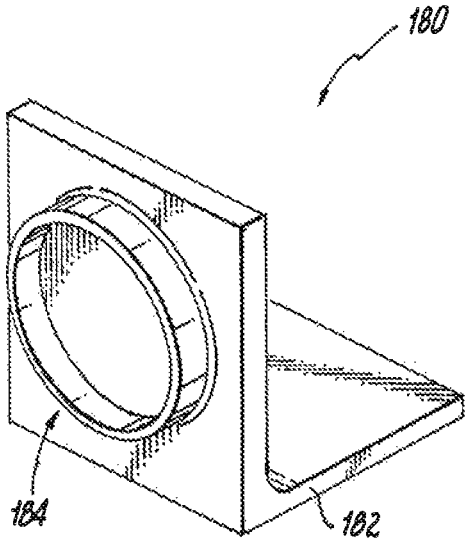
Fig. 8

HEAT SWITCH RADIATORS FOR VARIABLE RATE HEAT REJECTION

GOVERNMENT LICENSE RIGHTS STATEMENT

This invention was made with government support under Contract No. NNL13AB40P-CLIN001 awarded by the National Aeronautics and Space Administration. The government has certain rights in the invention.

BACKGROUND OF THE INVENTION

1. Field of the Invention

The present disclosure relates to thermal management systems, and more particularly to heat switch radiators for variable heat rejection thermal management systems.

2. Description of Related Art

Space vehicles commonly employ thermal management systems to control the temperature of vehicle components, such as electronics. Such systems typically include heat sinks operative to reject heat to the external environment. The temperature of such heat sinks can change as the vehicle operating environment changes, such as when the vehicle passes into or out of direct sunlight. This can alter the heat transfer rate as such heat sinks can more readily reject heat when cold than when warm. Some space vehicle thermal management systems therefore include a supplemental heat rejection device, such as a sublimator, evaporator, variable conductance heat pipe, or pumped coolant loop with a regenerative heat exchanger for managing change in the vehicle operating environment.

Such conventional methods and systems have generally been considered satisfactory for their intended purposes. However, there is still a need in the art for thermal management systems that provide variable heat rejection rates for operation in both cold and warm environments. The present disclosure provides a solution for these needs.

SUMMARY OF THE INVENTION

A heat switch radiator includes a heat sink, a coolant tube, and an actuator. The coolant tube is movable with respect to the heat sink. The actuator couples the heat sink to the coolant tube for moving the coolant tube between first and second positions. Heat flow from the coolant tube to the heat sink is greater in the second position than the first position for enhanced heat transfer from the coolant tube in warm operating environments.

In certain embodiments, heat flow between the coolant tube and heat sink can be at an angle with respect to the direction of coolant tube movement. The angle can be orthogonal with respect to the direction of coolant tube movement. Heat flow from the coolant tube to the heat sink can be about twelve times greater when the coolant tube is in the second position than when the coolant tube is in the first position. The actuator can be a passive thermal actuator for changing the rate of heat transfer by moving the coolant tube from the first position to the second position. The rate of heat transfer can vary over a predetermined temperature range.

In accordance with certain embodiments, the heat sink can have laterally offset teeth that define a channel between the teeth. The coolant tube can have longitudinally spaced teeth disposed within the heat sink channel and facing the heat sink teeth. The coolant tube teeth can be adjacent to the heat sink teeth when the coolant tube is in the second position. Thermal gaskets can connect to the facing surfaces of the heat sink teeth for transferring heat from the coolant tube to the heat sink. A graphite velvet material flocked to the underlying tooth can form the thermal gaskets. The coolant tube teeth, thermal gaskets, and heat sink teeth can form a thermal circuit for transferring heat from the coolant tube to the heat sink in the second position.

It is contemplated that the coolant tube can have a guide support. An enclosure with an inner surface can enclose the coolant tube and heat sink. A tube guide can connect to an inner surface of the enclosure and be slidably received in the guide support for supporting the coolant tube. A material having low thermal conductivity can form the enclosure for providing a high resistance heat transfer path between the coolant tube and the heat sink. The actuator can couple between the enclosure and coolant tube for displacing the coolant tube along a movement axis between the first position and second position.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 2 is a perspective view of the radiator of the assembly of FIG. 1, showing construction of the radiator;

FIG. 3 is a perspective view of the thermal gasket of heat switch radiator of FIG. 1, showing the gasket configuration;

FIG. 6 is a side view of the actuator of the heat switch radiator of FIG. 1, showing fixed and movable portions of the actuator;

FIG. 7 is a perspective side view of a resilient member of the heat switch radiator of FIG. 1, showing a spring, according to an embodiment;

FIG. 8 is a perspective view of the bracket of the heat switch radiator of FIG. 1, showing the engagement surface of the bracket.

DETAILED DESCRIPTION OF THE PREFERRED EMBODIMENTS

Figure 1:
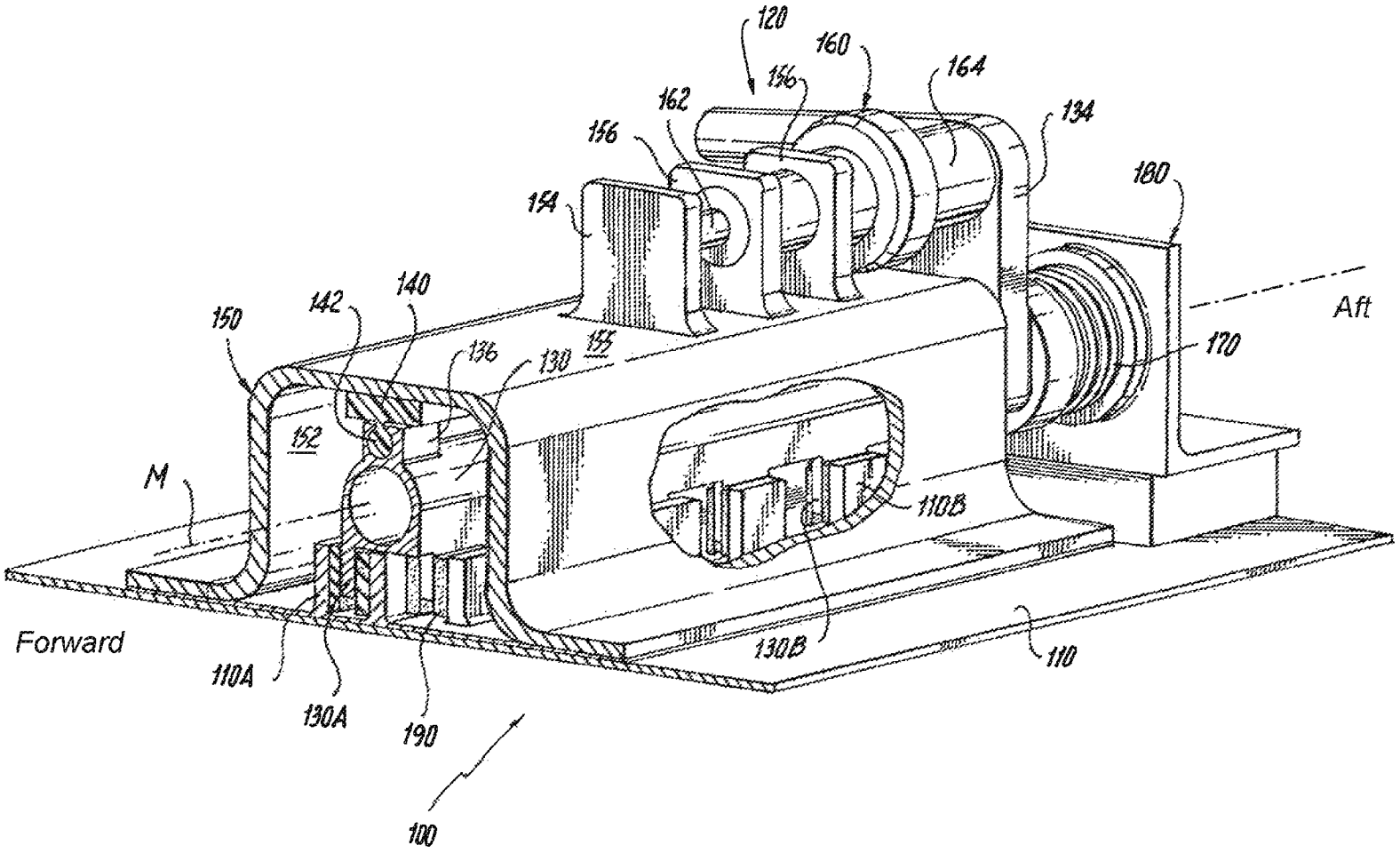
FIG. 1 is a perspective view of an exemplary embodiment of a heat switch radiator constructed in accordance with the present disclosure, showing the heat switch.

Reference will now be made to the drawings wherein like reference numerals identify similar structural features or aspects of the subject disclosure. For purposes of explanation and illustration, and not limitation, a partial view of an exemplary embodiment of the heat switch radiator assembly in accordance with the disclosure is shown in FIG. 1 and is designated generally by reference character 100. Other embodiments of a heat switch radiator in accordance with the disclosure, or aspects thereof, are provided in FIGS. 2-9B, as will be described. The systems and methods described herein can be used in thermal management systems, such as heat rejection systems for space vehicles.

Heat switch radiator 100 includes a heat switch 120 and a radiator 110. Heat switch 120 includes a coolant tube 130 with a plurality of coolant tube teeth 130A and 130B configured for transferring heat from coolant traversing coolant tube 130 to radiator 110. Radiator 110 includes a plurality of corresponding radiator teeth 110A and 110B configured for receiving heat from coolant tube teeth 130A and 130B and rejecting the heat to the external environment.

Heat switch radiator 100 also includes an enclosure 150 and a tube guide 140. Enclosure 150 connects to radiator 110 and houses a portion of coolant tube 130, coolant tube teeth 130A and 130B, and radiator teeth 110A and 110B. Tube guide 140 connects to an inner surface 152 of enclosure 150 and defines a guide portion 142 extending along its longitudinal length. Coolant tube 130 defines a slotted portion 136 corresponding to guide portion 142 for slidably seating guide portion 142. Slidably seating guide portion 142 in slotted portion 136 allows for movement of coolant tube 130 along a movement axis M that is parallel with guide portion 142 for displacement of coolant tube 130 between a first position, e.g. the 'off position', (shown in FIG. 9A) and a second position, e.g. the 'on position', (shown in FIG. 1 and FIG. 9B).

In order to facilitate smooth movement (e.g. without binding coolant tube 130), it is contemplated that tube guide 140 be constructed from a material that does not bind with the material from which coolant tube 130 is constructed. This will allow smooth movement of coolant tube 130 in relation to tube guide 140. Tube guide 140 may be constructed from a low friction plastic material, or a graphite-loaded or self-lubricating plastic having similar advantages. Those skilled in the art will know other suitable materials.

Heat switch 120 additionally includes an actuator 160 operatively associated with coolant tube 130 for moving coolant tube 130 between the first and second positions. Actuator 160 includes a fixed portion 162 and a movable portion 164. Fixed portion 162 abuts a stop 154 formed on an outer surface 155 of enclosure 150. Movable portion 164 extends through guides 156 formed on outer surface 155 of enclosure 150 and abuts an elbow 134 defined by coolant tube 130. Actuator 160 is configured to change in length in response to temperature through operation of a thermally expandable body 166 (shown in FIG. 6) disposed therein, e.g. meltable wax. Expandable body 166 is formed from a material that changes in volume in response to temperature change and couples fixed portion 162 to movable portion 164 for displacing one relative to another in response to temperature change. Expansion of thermally expandable body 166 causes actuator 160 to increase in length, actuator 160 having a first length at a first predetermined temperature and a second length at a second predetermined temperature.

When at or below the first predetermined temperature, actuator 160 assumes its first length. When exposed to temperatures above the first predetermined temperature, actuator 160 lengthens by displacing movable portion 164 in the aft direction relative to fixed portion 162, assuming its second length. Assuming its second length applies an aft-directed force on elbow 134 that drives coolant tube 130 in the aft direction along movement axis M as oriented in FIG. 1.

A resilient member 170 extends between elbow 134 and a bracket 180. Bracket 180 is fixed with respect to fixed portion 162 of actuator 160. As actuator 160 drives coolant tube 130 in the aft direction, elbow 134 compresses resilient member 170. This causes resilient member 170 to apply an opposite, forward directed force on elbow 134 that is a function of the compression experienced by resilient member 170. Movement of coolant tube 130 ceases once the forward-directed force resulting from compression of resilient member 170 reaches the same magnitude as the aft-directed force imposed by actuator 160 on elbow 134 or when actuator 160 reaches its second predetermined temperature (and second length).

From its second length, upon exposure to temperature below the second predetermined temperature, actuator 160 reduces the aft-directed force applied to elbow 134. As aft-directed force applied by actuator 160 on elbow 134 drops, the forward-directed force applied by resilient member 170 drives coolant tube 130 forward along movement axis M, thereby displacing movable portion 164 toward fixed portion 162 of actuator 160 and reducing the length of actuator 160. Forward-directed movement of coolant tube 130 ceases once the forward-directed force reaches the same magnitude as the aft force imposed by actuator 160 on elbow 134 or when actuator 160 reaches its first predetermined temperature (and first length).

Figure 9A:
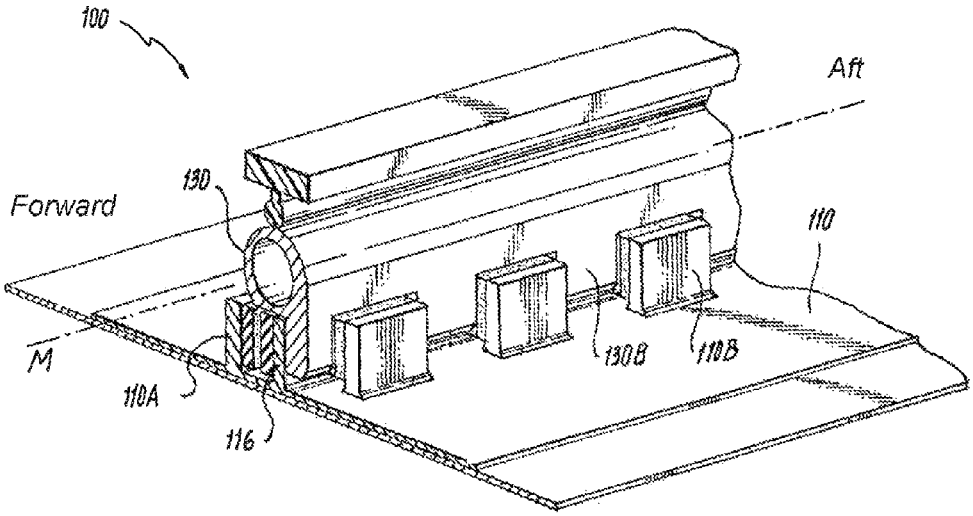
FIGS. 9A and 9B are perspective views of a portion of the heat switch radiator of FIG. 1, showing the coolant tube in the first and second positions, respectively.

With reference to FIG. 2, radiator 110 is shown. Radiator 110 is a heat sink and includes a radiator body 112, a first comb 114, a rail 116, and a second comb 118. Rail 116 extends longitudinally and in parallel with movement axis M. First comb 114 is offset laterally from rail 116 and formed of a plurality of longitudinally staggered teeth 110A. Only a single tooth 110A is referenced in FIG. 2 for clarity. Second comb 118 is offset laterally from rail 116 on a side opposite first comb 114 and formed of a plurality of longitudinally staggered teeth 110B. Only a single tooth 110B is referenced in FIG. 2 for clarity. First comb 114 and rail 116 bound a first channel 111 and first channel 111 extends longitudinally between rail 116 and first comb 114. Second comb 118 and rail 116 bound a second channel 113 and second channel 113 extends longitudinally between rail 116 and second comb 118. As illustrated in FIG. 9A, thermal gaskets 190 are flocked to lateral surfaces of teeth 110A and 110B facing channel 111 and 113. Thermal gaskets 190 are also flocked to rail 116 on surface portions facing teeth 110A and 110B. In embodiments, thermal gaskets are disposed on respective surfaces of coolant tube teeth 130A and 130B facing surfaces of first comb 114, rail 116, and second comb 118.

Radiator body 112 is fabricated from a material having suitable heat transfer for an intended application, such as aluminum, and can be fabricated via an extrusion process or any other suitable process. First comb 114 and second comb 118 can be formed from an extrusion by milling gaps to form longitudinally adjacent teeth. Those skilled in the art will readily appreciate that any other suitable techniques can be used for fabricating body 112, first comb 114, rail 116, and second comb 118.

With reference to FIG. 3, thermal gasket 190 is shown. A body 192 forming thermal gasket 190 has a first lateral face 194, a second lateral face 196, and a thickness 198. Thermal gasket 190 is formed from a compliant thermal interface material that has low thermal resistance at low clamping pressure, such as graphite velvet. Gaskets 190 may be flocked to the facing surfaces of teeth 110A and 110B and surfaces of rail 116 facing teeth 110A and 110B. One such complaint thermal interface material is Vel-Therm® material, available from Energy Science Laboratories, Inc. of San Diego, Calif.

Figure 4:
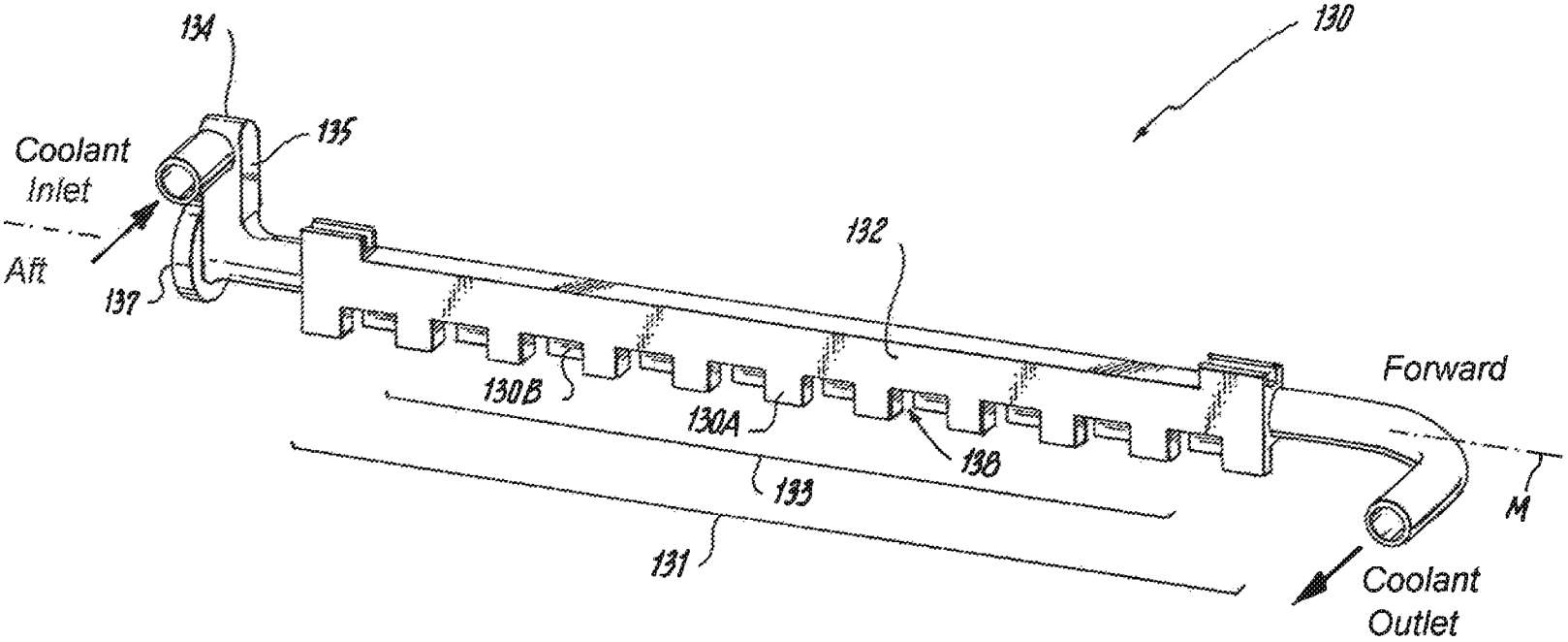
FIG. 4 is a perspective view of the coolant tube of the heat switch radiator of FIG. 1, showing construction of the coolant tube.

With reference to FIG. 4, coolant tube 130 is shown. Coolant tube 130 includes a coolant tube body 132 defining an internal coolant channel extending between a coolant inlet and a coolant outlet. Coolant tube body 132 includes a thermally conductive material, such as aluminum, and is configured to form a movable segment of a coolant circuit, e.g., operatively associated with a space vehicle.

On its upper portion and aft end, coolant tube body 132 defines elbow 134. On its lower portion, coolant tube body 132 defines a first longitudinally extending comb 131 and a second longitudinally extending comb 133. First comb 131 includes a longitudinally extending row of teeth 130A, only a single tooth 130A identified in FIG. 4. Second comb 133 includes a longitudinally extending row of teeth 130B, only a single tooth 130B identified in FIG. 4. Each tooth 130B of first comb 131 is longitudinally staggered with respect to each tooth 130A of second comb 133. First and second combs 131 and 133 define a longitudinally extending groove 138 between facing surfaces of teeth 130A and 130B. Groove 138 is configured for seating over rail 116 (shown in FIG. 2) such that the teeth forming first comb 131 are disposed within first channel 111 and the teeth forming second comb 133 are disposed within second channel 113.

Elbow 134 has a first engagement surface 137 on its aft face and a second engagement surface 135 on its forward face. First engagement surface 137 is configured for seating a first end 174 of resilient member 170 (shown in FIG. 7) and second engagement surface 135 is configured for being engaged by actuator 160 (shown in FIG. 6), transmitting force therebetween. This allows for forces generated by actuator 160 and resilient member 170 to be transferred to coolant tube 130, thereby moving coolant tube 130 between the first and second positions along movement axis M. Force applied at first engagement surface 137 by resilient member 170 is along movement axis M. Force applied at second engagement surface 135 by actuator 160 is off-axis and parallel with respect to movement axis M.

Figure 5:
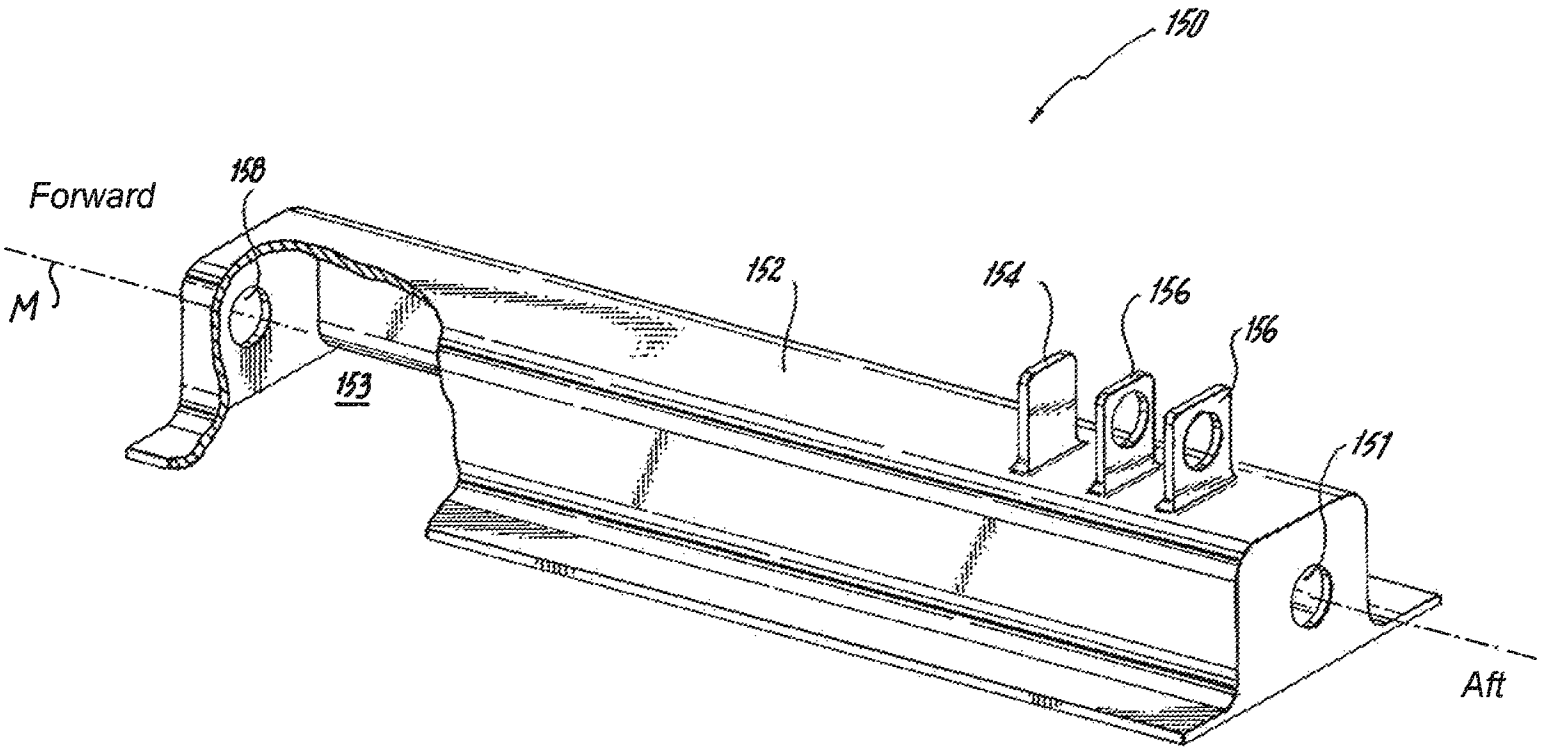
FIG. 5 is a perspective view of the enclosure of the heat switch radiator of FIG. 1, showing construction of the enclosure.

With reference to FIG. 5, enclosure 150 is shown. Enclosure 150 has an enclosure body 152 constructed of a material with relatively high thermal resistance, such as a fiberglass honeycomb composite structure. Enclosure 150 couples coolant tube 130 to radiator 110 and provides a heat transfer path through tube guide 140 and enclosure 150 with high thermal resistance between coolant tube 130 and radiator 110. This prevents excessive heat loss through enclosure 150 from coolant tube 130 during operation of heat switch radiator 100 in cold environments.

Enclosure 150 defines a forward aperture 158, an aft aperture 151, and longitudinally extending chamber 153. Forward aperture 158 and aft aperture 151 are configured to slidably receive forward and aft end portions of coolant tube 130. It is contemplated that forward and aft bellows structures (omitted for clarity purposes) seat between enclosure 150 and opposite respective ends of coolant tube 130 for allowing coolant tube 130 to sealably move within chamber 153 along movement axis M with respect to enclosure 150. In certain embodiments, enclosure 150 enables maintenance of a sealed environment for impounding particulate within chamber 153 that may shed from thermal gaskets 190 within enclosure 150.

On its aft end enclosure body 152 defines stop 154 and guides 156. Stop 154 extends orthogonally with respect to movement axis M and provides a surface configured to seat fixed portion 162 of actuator 160 (shown in FIG. 1). Guides 156 define respective apertures configured to slidably receive movable portion 164 of actuator 160. This allows for actuator 160 to exert force against enclosure 150 along an axis parallel and to offset from movement axis M for moving coolant tube 130 (shown in FIG. 4) along movement axis M within chamber 158. As illustrated, stop 154 and guides 156 are located on an aft end of enclosure 150. This is for illustration purposes only and non-limiting as it is contemplated that actuator 160 can engage enclosure 150 on its forward end, mid-section or other portions for purposes of displacing coolant tube 130. Further, any other suitable configuration for seating (or otherwise engaging) can be used as can any other suitable method for ensuring that actuator 160 exerts force along movement axis M.

With reference to FIG. 6, actuator 160 is shown. Actuator 160 includes a fixed portion 162, movable portion 164, and an expandable body 166. Fixed portion 162 is configured for seating against stop 154 (shown in FIG. 5). Movable portion 164 is configured for being slidably received within guides 156 (shown in FIG. 5). Actuator 160 should have suitable throw, i.e. it should exhibit sufficient length change upon reaching a predetermined temperature to move coolant tube 130 a distance necessary to affect the desired temperature change. One such suitable actuator is the 5019 Series linear motion thermal actuator available from Rostra Vernatherm of Bristol, Conn.

In embodiments, heat switch radiators described herein have thermal conductances that are about eight to fifteen times higher when coolant tube 130 is in the second position than when coolant tube 130 is in the first position. It is further contemplated that embodiments of heat switch radiator 100 can exhibit its full range of throw over a temperature change of 5 to 20 degrees Fahrenheit (3 to 11 degrees Celsius). In certain embodiments, two or more actuators 160 couple to coolant tube 130 for moving coolant tube 130 from the first position to the second position.

With reference to FIG. 7, resilient member 170 is shown. Resilient member 170 has a body 172 extending between a first end 174 and a second end 176. First end 174 is configured for seating against coolant tube 130 (shown in FIG. 1) and applying an axial force to coolant tube 130 along movement axis M. Second end 176 is configured for seating against bracket 180 and applying an axial force thereto. As illustrated in FIG. 7, resilient member 170 is a helical spring arranged axially aft of coolant tube 130. It is contemplated that resilient member 170 can also be a Belleville washer or another type of resilient element with suitable spring constant for developing opposing force in response to lengthening of actuator 160. In embodiments, two or more resilient members 170 couple to coolant tube 130 for applying force to coolant tube 130.

With reference to FIG. 8, bracket 180 is shown. Bracket 180 has a body 182 defining an engagement surface 184. Body 182 is configured to be fixed with respect to enclosure 150 (shown in FIG. 5). Engagement surface 184 is configured to seat second end 176 of resilient member 170 and transmit force thereto.

With reference to FIG. 9A, heat switch radiator 100 is shown in the first position (with enclosure 150 removed for illustration purposes). Coolant tube 130 is positioned relative to radiator 110 along movement axis M such that teeth (130A and 130B referenced only for clarity) of first and second combs 131 and 133 are longitudinally offset and isolated from teeth (110A and 110B referenced only for clarity) of first and second radiator combs 114 and 118 as well as rail 116. This reduces contact area between coolant tube 130 and radiator 110, reducing heat transfer between coolant tube 130 and radiator 110. Reducing heat transfer between coolant tube 130 and radiator 110 by moving coolant tube 130 to the first position can prevent excessive heat transfer from coolant tube 130 when radiator 110 is extremely cold, such as when not exposed to direct sunlight.

Figure 9B:
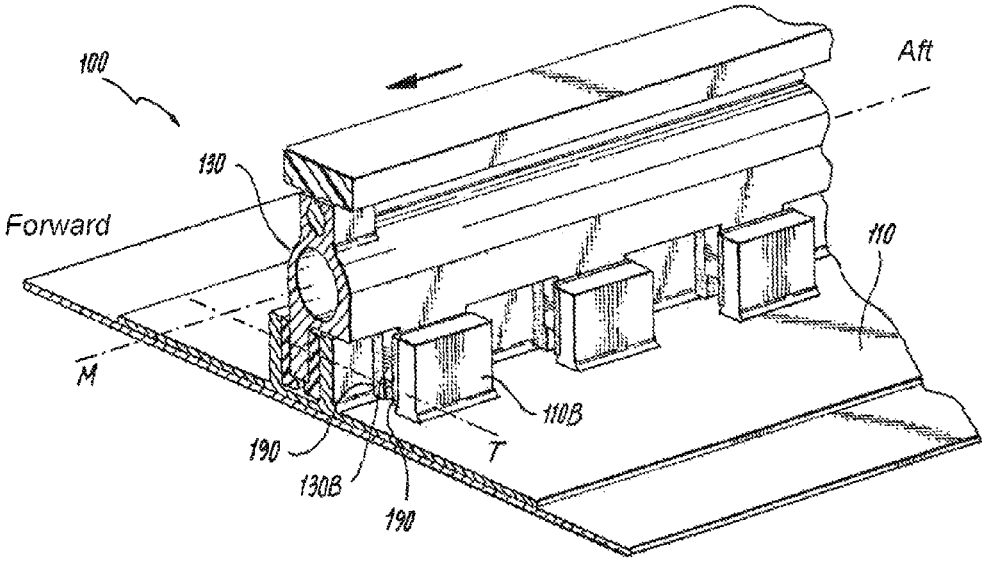

With reference to FIG. 9B, heat switch radiator 100 is shown in the second position (with enclosure 150 removed for illustration purposes). Coolant tube 130 is positioned relative to radiator 110 along movement axis M such that teeth (130A and 130B referenced only for clarity) of first and second combs 131 and 133 are laterally adjacent to the teeth (110A and 110B referenced only for clarity) of first and second radiator combs 114 and 118. Since teeth forming combs 131 and 133 have lateral thicknesses that are at least the size of respective gaps between laterally facing thermal gaskets 190, movement of coolant tube 130 into the second position places the teeth 130A and 130B in thermal communication with thermal gaskets 190. This establishes a heat flow along axis T directed orthogonally with respect to movement axis M, as shown in FIG. 9B, enhancing heat transfer between coolant tube 130 and radiator 110 and providing a relatively high rate of heat transfer from coolant tube 130 to radiator 110. In embodiments, heat transfer between coolant tube 130 and radiator 110 can be about twelve times greater in the second position than heat transfer in the first position.

The methods and systems of the present disclosure, as described above and shown in the drawings, provide for thermal management systems with superior properties including high turn-down ratio heat transfer for operation in both cold and warm environments. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A heat switch radiator, comprising:

a heat sink;

a coolant tube movable with respect to the heat sink along a longitudinal axis of the coolant tube; and an actuator coupled between the heat sink and the coolant tube, wherein the actuator is configured to move the coolant tube between the first and second positions such that heat flows between the coolant tube and the heat sink at a first rate in the first position and at a second rate in the second position, wherein the second rate is greater than the first rate, wherein the heat sink has a first tooth and a second tooth laterally offset from the first tooth relative to the longitudinal axis of the coolant tube, the first and second teeth defining therebetween a channel, wherein the coolant tube has a coolant tube tooth disposed within the channel, wherein movement of the coolant tube between the first and second positions displaces the coolant tube tooth longitudinally relative to the longitudinal axis of the coolant tube within the channel.

2. The heat switch radiator as recited in claim 1, wherein heat flow between the heat sink and the coolant tube is at an angle with respect to the longitudinal axis of the coolant tube.

3. The heat switch radiator as recited in claim 2, wherein heat flow between the heat sink and the coolant tube is orthogonal to the longitudinal axis of the coolant tube.

4. The heat switch radiator as recited in claim 1, wherein the actuator is configured to move the coolant tube between the first and second positions over a predetermined temperature range.

5. The heat switch radiator as recited in claim 1, wherein each tooth includes a thermal gasket in thermal contact with the tooth, each gasket disposed within the channel.

6. The heat switch radiator as recited in claim 5, wherein each coolant tube tooth contacts thermal gaskets of the first and second heat sink teeth when the coolant tube is in the second position.

7. The heat switch radiator as recited in claim 6, wherein the tube, the teeth, and the gasket define a closed thermal circuit for conveying heat between the coolant tube and the heat sink when the coolant tube is in the second position.

8. The heat switch radiator as recited in claim 5, wherein each coolant tube tooth is out of contact with the thermal gasket when the coolant tube is in the first position.

9. The heat switch radiator as recited in claim 1, wherein the coolant tube defines a guide support, and further including a tube guide slidably received within the guide support.

10. The heat switch radiator as recited in claim 9, further including an enclosure enclosing the tube and the teeth.

11. The heat switch radiator as recited in claim 9, wherein the enclosure couples the coolant tube to the radiator through a tube guide.

12. A high turn-down radiator, comprising:

a heat sink with a first row of heat sink teeth laterally offset from a second row of heat sink teeth, the rows of heat sink teeth having facing surfaces;

a movable coolant tube with a row of coolant tube teeth and a guide support, the coolant tube teeth being disposed between first and second rows of heat sink teeth;

thermal gaskets arranged between the teeth of coolant tube and the heat sink teeth;

a tube guide slidably received within the guide support;

an enclosure coupling the heat sink to the tube guide; and an actuator coupled to the enclosure and the coolant tube, wherein the actuator is configured to move the coolant tube between first and second positions such that heat flow between the heat sink and the coolant tube in the second position is greater than the heat flow between the heat sink and the coolant tube in the first position.

13. The high turn-down radiator as recited in claim 12, wherein heat flow is orthogonal with respect to the direction of coolant tube movement between the first and second positions.

14. The high turn-down radiator as recited in claim 12, wherein the thermal gaskets are attached to the facing surfaces of the first and second rows of heat sink teeth.

* * * * *